US011913229B2

(12) United States Patent
Bailey et al.

(10) Patent No.: US 11,913,229 B2
(45) Date of Patent: Feb. 27, 2024

(54) RAISED GUTTER COVER

(71) Applicant: GPI Home Solutions, Elkhorn, NE (US)

(72) Inventors: Lance Bailey, Elkhorn, NE (US); Randy Bailey, Elkhorn, NE (US); David Herdrich, Elkhorn, NE (US); Brian Beck, Elkhorn, NE (US)

( * ) Notice: Subject to any disclaimer, the term of this patent is extended or adjusted under 35 U.S.C. 154(b) by 0 days.

(21) Appl. No.: 17/698,944

(22) Filed: Mar. 18, 2022

(65) Prior Publication Data

US 2022/0298796 A1 Sep. 22, 2022

Related U.S. Application Data

(60) Provisional application No. 63/163,613, filed on Mar. 19, 2021.

(51) Int. Cl.
*E04D 13/076* (2006.01)

(52) U.S. Cl.
CPC ..... *E04D 13/076* (2013.01)

(58) Field of Classification Search
CPC ..... E04D 13/076
USPC ..... 52/12
See application file for complete search history.

(56) References Cited

U.S. PATENT DOCUMENTS

| | | | | |
|---|---|---|---|---|
| 4,937,986 | A * | 7/1990 | Way, Sr. | E04D 13/076 52/12 |
| 10,125,496 | B2 * | 11/2018 | Lenney | E04D 13/076 |
| 2006/0101722 | A1 * | 5/2006 | Ealer, Sr. | E04D 13/076 52/12 |
| 2011/0041414 | A1 * | 2/2011 | Bell | E04D 13/0725 52/12 |
| 2011/0138697 | A1 * | 6/2011 | Martin | E04D 13/0727 52/12 |
| 2011/0185641 | A1 * | 8/2011 | Snell | E04D 13/076 52/12 |
| 2015/0089883 | A1 * | 4/2015 | Peck | E04D 13/076 52/12 |
| 2015/0354226 | A1 * | 12/2015 | Lenney | E04D 13/064 52/12 |
| 2021/0102379 | A1 * | 4/2021 | Moran | E04D 13/076 |
| 2022/0081909 | A1 * | 3/2022 | Brochu | E04D 13/0767 |

FOREIGN PATENT DOCUMENTS

| | | | | |
|---|---|---|---|---|
| CA | 2723499 | A1 * | 3/2011 | E04D 13/076 |
| GB | 2084210 | A * | 4/1982 | E04D 13/076 |
| GB | 2351757 | A * | 1/2001 | E04D 13/076 |
| GB | 2352458 | A * | 1/2001 | E04D 13/004 |

* cited by examiner

*Primary Examiner* — Babajide A Demuren
(74) *Attorney, Agent, or Firm* — Dax D. Anderson; Kirton McConkie

(57) ABSTRACT

A raised gutter cover that is live loaded and acts as a compressions spring when mounted on a gutter hung with high-hangers and securely attaches the gutter cover to the gutter and the building allowing water shed from the pitched roof to separate from any debris and strain through the gutter.

7 Claims, 1 Drawing Sheet

RAISED GUTTER COVER

TECHNICAL FIELD

The present disclosure relates generally to a gutter cover. More particularly, the disclosure relates to a gutter cover configured to span the space between the gutter lip and the roof line while staying substantially above the gutter channel.

BACKGROUND

A rain gutter, eavestrough, eaves-shoot or surface water collection channel is a component of a water discharge system for a building. It is necessary to prevent water dripping or flowing off roofs in an uncontrolled manner for several reasons: to prevent it damaging the walls, drenching persons standing below or entering the building, and to direct the water to a suitable disposal site where it will not damage the foundations of the building. In the case of a flat roof, removal of water is essential to prevent water ingress and to prevent a build-up of excessive weight.

Rain gutters are susceptible to capturing debris often found on a pitched roof. Debris can include leaves, loose shingles, dirt or even foreign objects such as tennis balls. Gutter covers are placed in gutters and are used to separate debris from the water. Specifically, are engineered to cover a gutter so that debris pushed down the pitched roof stops on top of the cover, allowing water to train from the debris, and then the debris is often blown off the cover by wind.

Gutters are installed using a variety of techniques, the most common involving a gutter hanger which is set inside the gutter trough below the top edge of the gutter. However, a recently-developed gutter hanger, the high-hanger, sits much higher in the gutter near or even extending above the top edge of the gutter. The high-hanger is popular because it allows easier access to the hanger during installation than the hanger that sits inside the trough, thus expediting gutter installation.

Often gutter covers are engineered to nest inside the gutter trough between the front top edge of the gutter. However, the high-hanger interfere with traditional gutter covers because of their position at or above the top edge of the gutter.

Thus a need exists for a gutter cover that can be mounted on a gutter hung with high-hangers, while still securely attaching the gutter cover to the gutter and the building and while allowing water shed from the pitched roof to separate from any debris and strain through the gutter.

BRIEF SUMMARY

A system of one or more gutter covers can be configured to cover a gutter while accommodating high hangers by virtue of having the gutter cover configured to extend above the top edge of the gutter installed on the gutter system. One general aspect includes a straining surface that may include a front edge portion. The straining surface also includes a second strata extends from the edge of the first sloped portion a first sloped and terminating in a second sloped portion; a third strata extending from the edge of the second sloped portion to a third sloped portion where the third sloped portion extends from the third strata to the second strata where the second strata is configured to abut an edge of a gutter and where the first strata and the second strata are disposed above the gutter so as to accommodate a gutter hanger placed at the top of a gutter. Other embodiments of this aspect include corresponding gutter covers or miter corners and apparatus, each configured to perform the actions of the methods.

Implementations may include one or more of the following features. The stratified gutter cover where the first strata of the screening surface may include a spring structure configured to exert an expanding force when compressed. The first strata of the screening surface may include a spring structure configured to exert an expanding force when compressed so as to expand against a roof line and the edge of a gutter. Implementations of the described techniques may include gutter cover hardware, a method or process.

One general aspect includes a gutter cover. The gutter also includes a spring surface configured to exert an expansion force when compressed; a non-spring surface connected to the spring surface by a sloped region where the non-spring surface is configured to be co-planar with a third surface configured to rest on the lip of a gutter. Other embodiments of this aspect include corresponding gutter cover systems and apparatus each configured to perform the actions of the methods.

One general aspect includes a gutter cover configured to be disposed above the top edge of the gutter. The perforated gutter cover also includes a first edge configured to be screwed to the edge of a roof where the first edge is not planar with the edge of a roof; a spring portion having a concave segment and convex segment where the combination concave portion and convex portion are configured to exert an expansion force when compressed and where the spring portion is perforated, a first sloped portion extending from the spring portion where the first sloped portion is perforated, a perforated planar portion extending from the edge of the first sloped portion, a second sloped portion extending from the perforated planar portion and a third sloped portion sloped substantially opposite the second sloped portion where the second sloped portion and the third sloped portion are connected by a lacuna portion so as to form a lacuna between the second sloped portion and the third sloped portion, and a non-perforated portion substantially co-planar with the perforated planar portion where the non-perforated portion is configured to selectively couple to a gutter lip so as the lacuna portion is the only portion of the cover configured to be disposed within a gutter so as to allow the gutter cover to accommodate hangers fastened near the top lip of the gutter. Other embodiments of this aspect include corresponding gutter cover systems and apparatus, each configured to perform the actions of the methods.

The features and advantages of the present disclosure will become more fully apparent from the following description and appended claims or may be learned by the practice of the invention as set forth hereinafter.

BRIEF DESCRIPTION OF THE DRAWINGS

In order to describe the manner in which the advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present embodiments of the present disclosure will be best understood by reference to the drawings, wherein like parts are designated by like numerals throughout. It will be readily understood that the components of the disclosed invention, as generally described and illustrated in the figures herein, could be arranged and designed in a wide variety of different configurations. Thus, the following more detailed descriptions of the embodiments of the apparatus, as represented in FIGS. 1 through 2, are not intended to limit the scope of the invention, as claimed, but are merely representative of present embodiments of the invention.

In the following description, references will be made to gutter hanging materials and related buildings, but these items are not shown in detail in the figures. However, it should be understood that one of ordinary skill in the art and in possession of this disclosure, would readily understand how the present disclosure and existing gutter structures can be incorporated.

Figure 1:
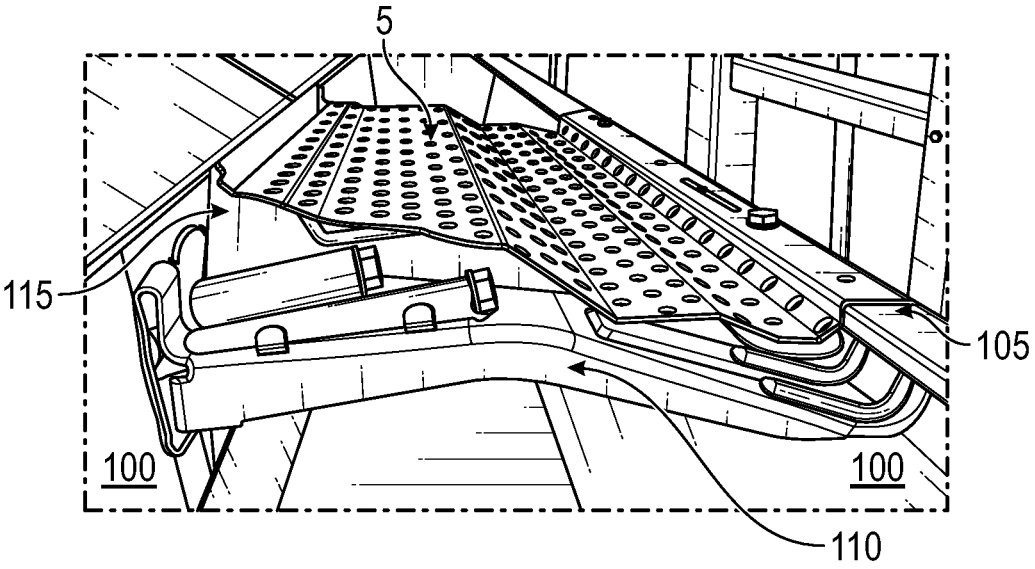
FIG. 1 illustrates the perspective view of the gutter cover disposed above a gutter.
Figure 2:
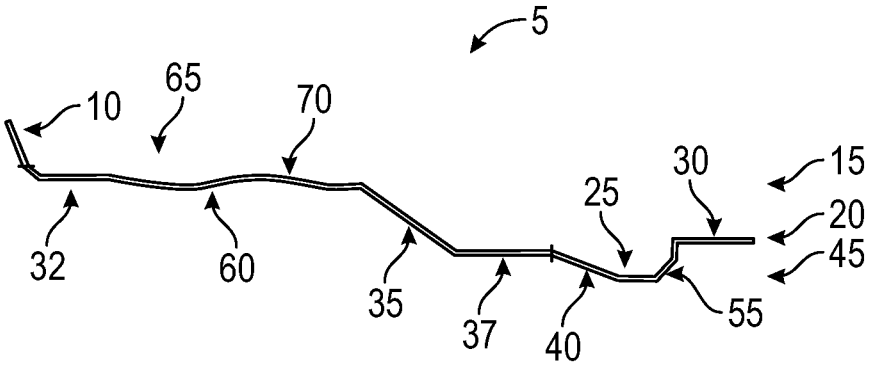
FIG. 2 illustrates a profile view of the gutter cover.

Detailed references will now be made to the preferred embodiments of the disclosed invention, examples of which are illustrated in FIGS. 1-2 illustrate various views of a gutter cover disposed above a gutter in accordance with one or more embodiments of the invention.

In general, the figures disclose an invention that separates water from debris such as leaves disposed above the gutter to accommodate a high hanger with an integrated screw.

In some embodiments attachment points at the front edge and the back edge of the cover strengthen the overall gutter system.

In some embodiments incorporated ridges strengthen the cover. In some embodiments ridges eliminate water run over. In some embodiments ridges encourage debris to quickly dry up and blow away by minimizing the amount of surface contact between the cover and the debris.

Some embodiments comprise a step-up profile. In some embodiments the step-up profile comprises allowing the cover to be installed over all current hanger styles. In some embodiments the step-up profile comprises allowing installation over high profile designs that incorporate an integral screw.

In some embodiments the step-up profile comprises construction materials including 100% high strength aluminum which resists deterioration and damage as well having a time tested hole pattern and size.

In one non-limiting embodiment, a stratified gutter cover comprises a straining surface. In some embodiments the gutter cover comprises a front edge portion. In some embodiments the gutter cover comprises a back edge portion. In some embodiments the gutter cover comprises a recessed or lacuna portion. In some embodiments the first strata comprises a member extending from the back edge portion and terminating in a first sloped portion.

In some embodiments a second strata extends from the edge of the first sloped portion a first sloped and terminating in a second sloped portion. In some embodiments the sloped portion is angled so as to keep the straining surface out of the gutter channel. In some embodiments the;

In some embodiments a third strata extends from the edge of the second sloped portion to a third sloped portion. In some embodiments the third sloped portion extends from the third strata to the second strata wherein the second strata is configured to abut an edge of a gutter. In some embodiments the first strata and the second strata are disposed above the gutter so as to accommodate a gutter hanger with an integrated screw placed at the top of a gutter.

In some embodiments the first strata of the screening surface comprises a spring structure configured to exert an expanding force when compressed.

In some embodiments the first strata of the screening surface comprises a spring structure configured to exert an expanding force when compressed so as to expand against a roof line and the edge of a gutter.

In some embodiments the gutter cover comprises a spring surface configured to exert an expansion force when compressed. In some embodiments a non-spring surface connected to the spring surface by a sloped region wherein the non-spring surface is configured to be co-planar with a third surface configured to rest on the lip of a gutter.

In some embodiments a perforated gutter cover comprises a first edge configured to be screwed to the edge of a roof wherein the first edge is not planar with the edge of a roof. In some embodiments a spring portion comprise a concave segment and convex segment wherein the combination concave portion and convex portion are configured to exert an expansion force when compressed and wherein the spring portion is perforated. In some embodiments a first sloped portion extends from the spring portion wherein the first sloped portion is perforated. In some embodiments a perforated planar portion extends from the edge of the first sloped portion. In some embodiments a second sloped portion extends from the perforated planar portion and a third sloped portion sloped substantially opposite the second sloped portion wherein the second sloped portion and the third sloped portion are connected by a lacuna portion so as to form a lacuna between the second sloped portion and the third sloped portion. Some embodiments comprise a non-perforated portion substantially co-planar with the perforated planar portion wherein the non-perforated portion is configured to selectively couple to a gutter lip so as the lacuna portion is the only portion of the cover configured to be disposed within a gutter so as to allow the gutter cover to accommodate hangers fastened near the top lip of the gutter.

In closing, it is to be understood that the embodiments of the disclosure disclosed herein are illustrative of the principles of the present disclosure. Other modifications that may be employed are within the scope of the disclosure. Thus, by way of example, but not of limitation, alternative configurations of the present disclosure may be utilized in accordance with the teachings herein. Accordingly, the present disclosure is not limited to that precisely as shown and described.

The invention claimed is:

1. A raised gutter cover comprising:

a straining surface (5) comprising a back edge portion (10), a first strata portion (15), a second strata portion (20), a lacuna portion (25) and a front edge 30) portion and wherein the first strata comprises a raised member (32) extending from the back edge portion and terminating in a first extended sloped (35) portion wherein the raised member further comprises a compression spring convex segment configured to flex transverse the straining surface;

the second strata comprising a water break member (37) extends from the edge of the first sloped portion and terminating in a second sloped (40) portion;

a third strata (45) comprises a trough (50) extending from the edge of the second sloped portion to a third sloped (55) portion wherein the third sloped portion extends from the third strata to the second strata wherein the second strata is configured to abut a lip (105) of a gutter (100);

and wherein the first strata and the second strata are configured to accommodate a high gutter hanger (110).

2. The raised gutter cover of claim 1 wherein the first strata of the straining surface comprises a spring structure (60) configured to exert an expanding force when compressed.

3. The raised gutter cover of claim 1 wherein the first strata of the straining surface comprises a spring structure configured to exert an expanding force when compressed so as to expand against a roof line (115) and the lip of a gutter.

4. The gutter cover of claim 1 wherein the combination of the first strata portion and the second strata portion comprise a compression spring.

5. The gutter cover of claim 1 wherein the combination of the first strata portion and the second strata portion and the third strata portion comprise a compression spring.

6. The gutter cover of claim 1 wherein the first strata portion maintains a substantially planar surface.

7. A perforated gutter cover comprising:

a first edge configured to be screwed to the edge of a roof wherein the first edge is not planar with the edge of a roof;

a spring portion having a combination concave segment (65) and convex segment (70) wherein the combination concave portion and convex portion are configured to exert an expansion force when compressed and wherein the spring portion is perforated; a first sloped portion extending from the spring portion wherein the first sloped portion is perforated;

a perforated planar portion extending from the edge of the first sloped portion;

a second sloped portion extending from the perforated planar portion and a third sloped portion sloped substantially opposite the second sloped portion wherein the second sloped portion and the third sloped portion are connected by a lacuna portion so as to form a lacuna between the second sloped portion and the third sloped portion; and a non-perforated portion substantially co-planar with the perforated planar portion wherein the non-perforated portion is configured to selectively couple to a gutter lip so as the lacuna portion is the only portion of the cover configured to be disposed within a gutter so as to allow the gutter cover to accommodate hangers fastened near a top lip of the gutter.

* * * * *